US007673788B2

(12) United States Patent
Calabretta

(10) Patent No.: US 7,673,788 B2
(45) Date of Patent: Mar. 9, 2010

(54) PACKAGE OPENING DEVICE

(76) Inventor: Mario Calabretta, 900 S. Lewis Rd., Royersford, PA (US) 19468

( * ) Notice: Subject to any disclaimer, the term of this patent is extended or adjusted under 35 U.S.C. 154(b) by 122 days.

(21) Appl. No.: 11/812,960

(22) Filed: Jun. 22, 2007

(65) Prior Publication Data

US 2008/0041907 A1 Feb. 21, 2008

Related U.S. Application Data

(60) Provisional application No. 60/837,943, filed on Aug. 16, 2006.

(51) Int. Cl.
*B65D 17/46* (2006.01)
*B26F 3/02* (2006.01)

(52) U.S. Cl. ..... 229/239; 225/97; 229/160.2; 229/238; 229/924; 383/206

(58) Field of Classification Search ..... 229/203, 229/238, 239, 924, 160.2, 117.26; 383/205, 383/206; 225/93, 97
See application file for complete search history.

(56) References Cited

U.S. PATENT DOCUMENTS 286,654 A * 10/1883 Tobias ..... 229/117.26
2,009,835 A * 7/1935 Burke ..... 383/205
2,119,793 A 6/1938 Plageman
2,583,669 A * 1/1952 Santina ..... 229/239
3,097,786 A * 7/1963 Militana ..... 229/235
3,130,895 A * 4/1964 Davis ..... 229/136
3,175,752 A 3/1965 Stabenow
3,187,983 A 6/1965 Mendoza
3,206,104 A * 9/1965 Cohen ..... 229/117.26
3,520,469 A 7/1970 Marx
3,567,108 A 3/1971 Corridon
3,900,105 A 8/1975 Wolfelsperger
4,038,425 A * 7/1977 Brandberg et al. ..... 229/902
4,420,080 A 12/1983 Nakamura
4,664,263 A 5/1987 Emslander et al.
4,679,693 A 7/1987 Forman
4,708,249 A 11/1987 Emslander et al.
4,838,429 A 6/1989 Fabisiewicz et al.
4,874,126 A * 10/1989 Miller ..... 229/160.2
5,042,681 A * 8/1991 Bolte et al. ..... 229/924

(Continued)

FOREIGN PATENT DOCUMENTS

JP 6293368 10/1994

(Continued)

*Primary Examiner*—Gary E Elkins
(74) *Attorney, Agent, or Firm*—Richard C. Litman

(57) ABSTRACT

The package opening device is an adhesive strip adapted for mounting on a cover of a package, the adhesive strip having a gripping member allowing the user to pull on the gripping member to tear at least a portion of the cover of the package. The package opening device includes a base strip having a proximal portion, a distal portion, an upper surface, and a lower surface. An adhesive layer at least partially covers the distal portion of the lower surface of the base strip, and the uncovered proximal portion forms the gripping member. Further, a release liner may be provided for covering the adhesive layer prior to application to the cover of the package. Alternatively, a plurality of adhesive strips may be provided, with the plurality of adhesive strips being joined together by a line, with user-generated tension in the line creating the tearing force.

7 Claims, 5 Drawing Sheets

U.S. PATENT DOCUMENTS

| | | | | |
|---|---|---|---|---|
| 5,080,263 | A | 1/1992 | Johnson | |
| 5,080,281 | A * | 1/1992 | Seabold | 229/117.26 |
| 5,213,208 | A | 5/1993 | Hillestad | |
| 5,215,381 | A | 6/1993 | Wade | |
| 5,378,066 | A | 1/1995 | Wade | |
| 5,702,039 | A * | 12/1997 | Olaiz | 224/409 |
| 5,855,435 | A | 1/1999 | Chiesa | |
| 6,059,178 | A * | 5/2000 | Malloy et al. | 229/102 |
| 6,698,928 | B2 | 3/2004 | Miller | |
| 2001/0000480 | A1 | 4/2001 | Stagg et al. | |
| 2004/0091184 | A1 | 5/2004 | Miller | |
| 2005/0202191 | A1 | 9/2005 | Nowak et al. | |

FOREIGN PATENT DOCUMENTS

| | | |
|---|---|---|
| JP | 9202369 | 8/1997 |
| JP | 20000190929 | 7/2000 |
| WO | WO 02/47872 A1 | 6/2002 |

* cited by examiner

PACKAGE OPENING DEVICE

CROSS-REFERENCE TO RELATED APPLICATION

This application claims the benefit of U.S. Provisional Patent Application Ser. No. 60/837,943, filed Aug. 16, 2006.

BACKGROUND OF THE INVENTION

1. Field of the Invention

The present invention relates to packaging, particularly to wrapper-type packaging, and more particularly to a package opening device for opening a tightly wrapped package.

2. Description of the Related Art

Packages having coverings formed from paper, plastic or the like are often difficult to open. Gifts, for example, often require the usage of multiple layers of specialized wrapping paper, which must be adhered together with tape or the like. It is often difficult, particularly for children, the elderly and invalids, to tear off the covering without causing damage to the underlying package, which may be formed from delicate materials.

Compact discs and DVDS, in particular, often present difficulties to the user, in that they are typically covered with shrink-wrapped plastic which is extremely difficult to remove. The use of scissors or knives to remove the plastic may damage the underlying package or case, and further presents a risk of injury to the user.

Although mailing envelopes and the like are commonly provided with tear-strips and other forms of user-releasable closures, such tear-strips and the like must be integrally formed with the envelope at the time of manufacture, not only increasing costs and complexity in the manufacturing process, but further removing the possibility of user-selective application of an opener to a desired package, which may be preferred for aesthetic or functional reasons. Thus, a package opening device solving the aforementioned problems is desired.

SUMMARY OF THE INVENTION

The package opening device is an adhesive strip adapted for mounting on a cover of a package. The adhesive strip has a gripping member, allowing the user to pull on the gripping member to tear at least a portion of the cover of the package. The package opening device includes a base strip having a proximal portion and a distal portion, and further having an upper surface and a lower surface. The base strip may be formed from paper, flexible plastic, cardboard or the like.

An adhesive layer at least partially covers the distal portion of the lower surface of the base strip, and the uncovered proximal portion forms the gripping member. Alternatively, a second gripping member may be formed opposite the proximal portion, with the adhesive layer only covering a portion of the distal portion of the base strip. Further, a separate grasping element, such as a ring or a user-selectable charm, for example, may be attached to the proximal portion, providing an enhanced gripping surface and adding ornamental features to the device.

Additionally, a release liner or backing strip may be provided for covering the adhesive layer prior to application to the cover of the package. Alternatively, a plurality of adhesive strips may be provided, with the plurality of adhesive strips being joined together by a line, with user-generated tension in the line creating the tearing force.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
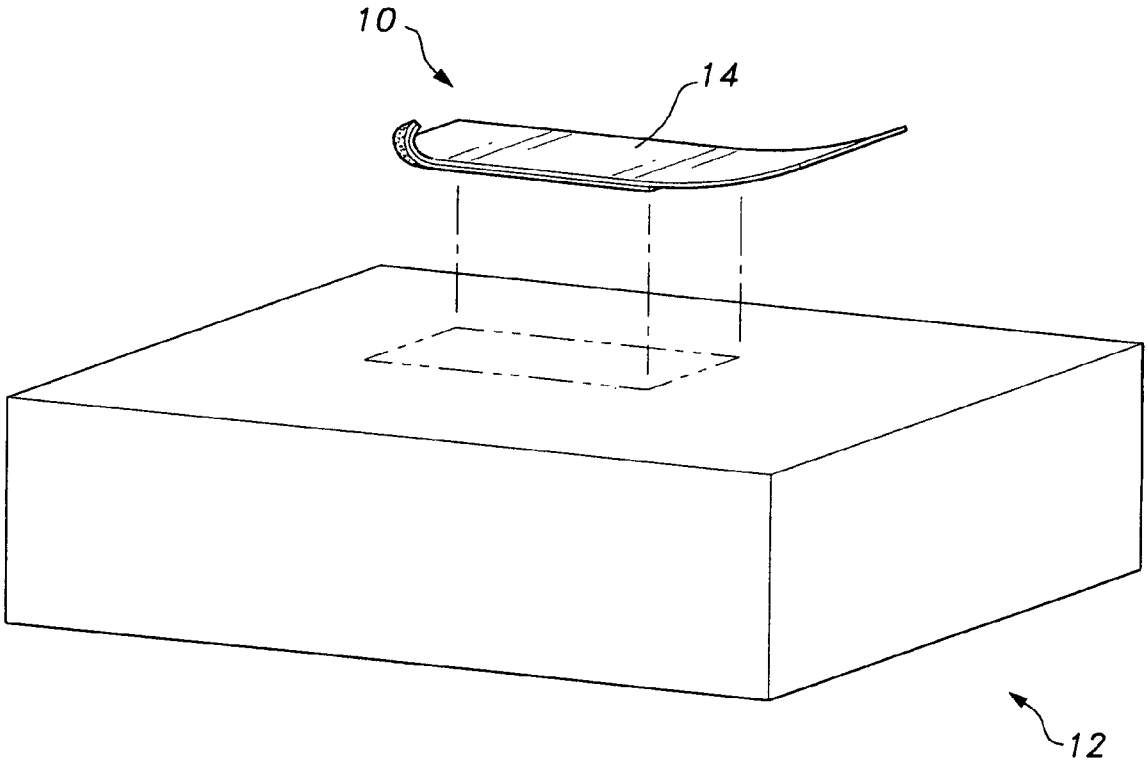
FIG. 1 is an environmental, perspective view of a package opening device according to the present invention.

The package opening device 10 is an adhesive strip adapted for mounting on a cover of a covered package 12, as illustrated in FIG. 1. As will be described in greater detail below, the adhesive strip includes a gripping member, allowing the user to pull on the gripping member to tear at least a portion of the cover of the package.

Figure 2:
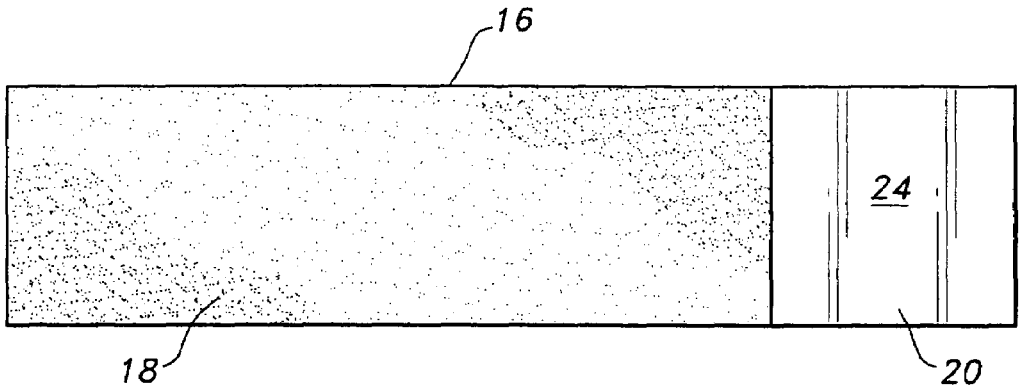
FIG. 2 is a bottom plan view of the package opening device according to the present invention.

As best shown in FIG. 2, the package opening device 10 includes a base strip 20 having a proximal portion and a distal portion, and further having an upper surface 14 and a lower surface 16. The base strip 20 may be formed from paper, flexible plastic, cardboard or the like. Preferably, the base strip 20 is formed from a flexible material having a tensile strength sufficient to allow the user to tear the cover of the covered package 12 without tearing the base strip 20 in the process.

Although shown in the drawings as having a substantially rectangular contour, it should be understood that base strip 20 may have any desired size or shape. The base strip 20 may be manufactured in a wide variety of user-selectable shapes, such as the rectangular shape shown, spirals, lightning-bolt shapes, or in any desired suitable user-selectable shape. Further, the user-selectable shape may be selected to match or complement the package contents or the design of the cover wrapper. Further, the upper surface 14 of base strip 20 may have user-selectable indicia imprinted thereon.

An adhesive layer 18 at least partially covers the distal portion of the lower surface of the base strip 20, and the uncovered proximal portion forms the gripping member 24. Alternatively, a second gripping member may be formed opposite the proximal portion, with the adhesive layer only covering a portion of the distal portion of the base strip 20.

The uncovered portion of the distal portion of the base strip 20 would form the second gripping member.

Figure 7:
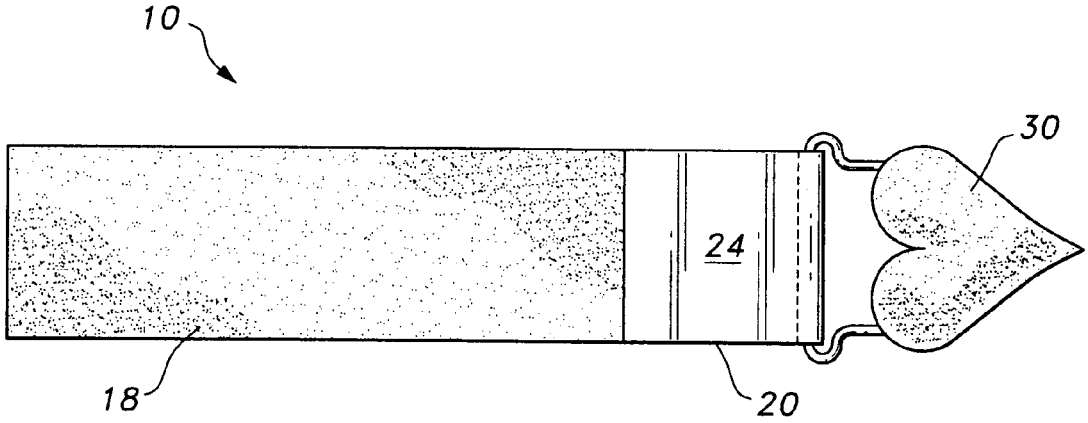
FIG. 7 is a bottom plan view of an alternative embodiment of the package opening device according to the present invention.

As illustrated in the embodiment of FIG. 7, a separate grasping element 30 may be secured to the proximal portion of base strip 20, providing an enhanced gripping surface and adding user-selectable ornamental features to the device 10. Although shown as being a heart-shaped charm, it should be understood that this is for exemplary purposes only, and that the grasping element 30 may have any desired suitable shape or size. The grasping element 30 may further be secured to the proximal portion of base strip 20 in any suitable manner. In FIG. 7, the grasping element 30 is shown as being fixed to the base strip 30 by a material loop, secured at one end to the adhesive layer 18. It should be understood that the material loop is shown for exemplary purposes only and that the grasping element may be secured to the base strip by any suitable means of attachment.

Figure 3:
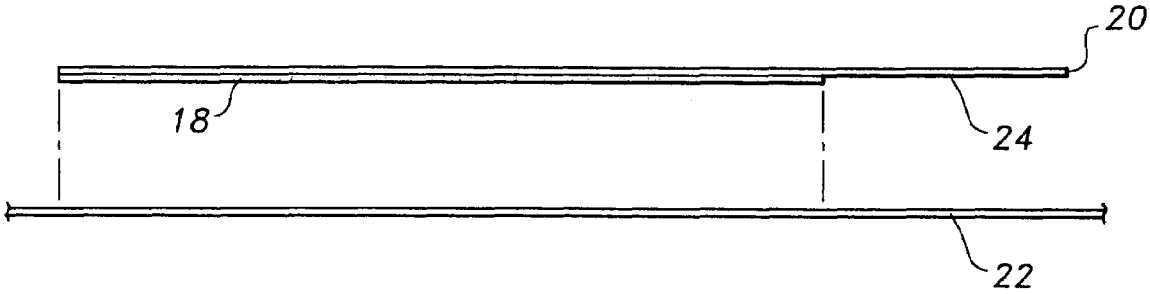
FIG. 3 is a side view of the package opening device according to the present invention.
Figure 4:
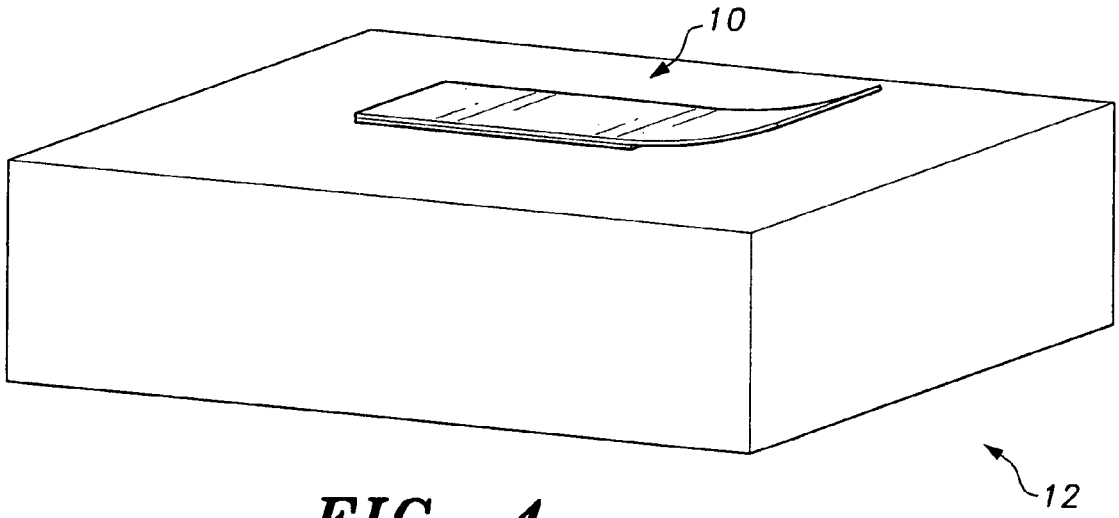
FIG. 4 is an environmental, perspective view of the package opening device according to the present invention, illustrating attachment of the package opening device to a cover of the package.

As shown in FIG. 3, a backing strip or release liner 22 may be provided for covering the adhesive layer 18 prior to application of the device 10 to the cover of the covered package 12. In use, the user removes the release liner 22 from the device 10 and adheres the base strip 20, via the adhesive layer 18, to the cover of the covered package 12, as shown in FIG. 4.

Figure 5:
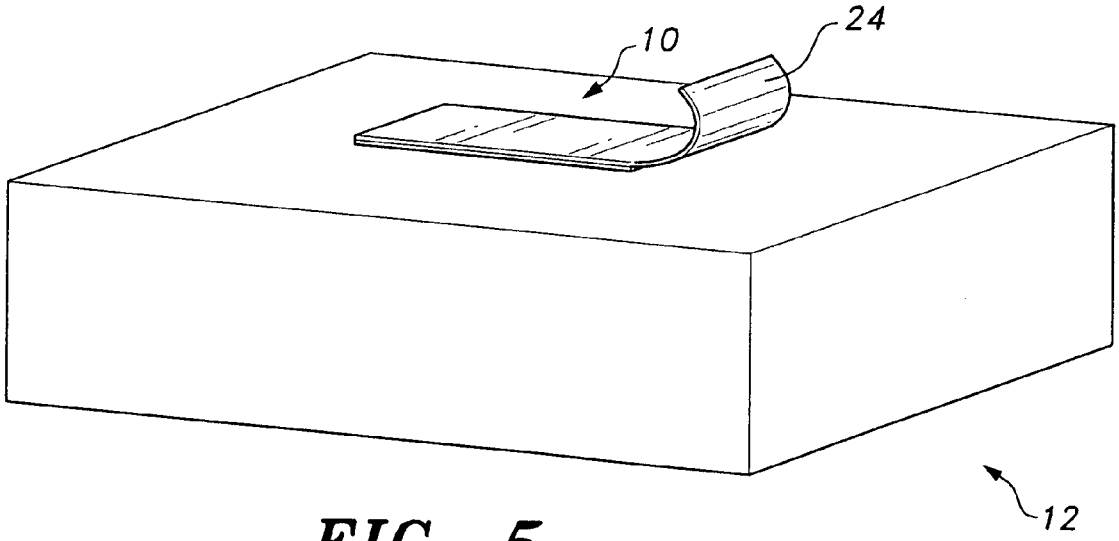
FIG. 5 is an environmental, perspective view of the package opening device according to the present invention, illustrating lifting of a gripping member of the package opening device, prior to tearing the cover of the package.

The gripping portion 24 of device 10 is formed from the uncovered proximal portion of the base strip 20 and, thus, does not adhere to the cover. The gripping portion 24 is free to be lifted from the package surface for grasping by the user, as shown in FIG. 5.

Figure 6:
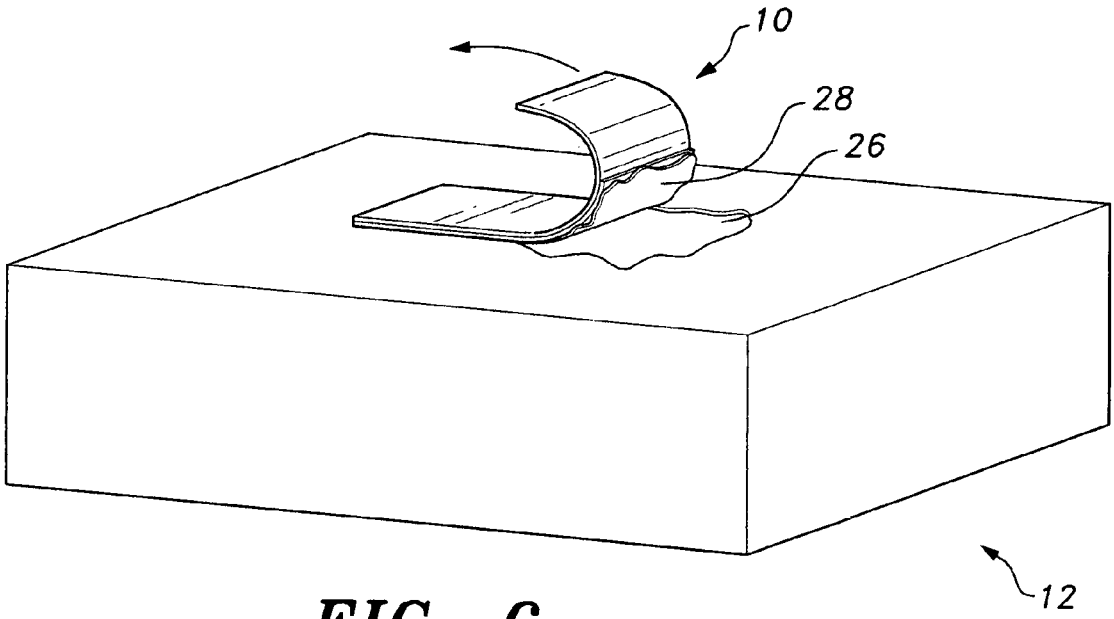
FIG. 6 is an environmental, perspective view of the package opening device according to the present invention, illustrating tearing of the cover of the package.

Following grasping of the gripping portion 24 (or the grasping element 30 of the embodiment of FIG. 7), the user applies an upward force to the gripping portion 24 (as indicated by the directional arrow in FIG. 6), and due to the adhesive layer 18 adhering to the cover, a portion of the cover 28 is torn away, exposing the underlying package surface 26. The adhesive layer 18 is preferably formed from adhesive materials having an adhesion strong enough to tear at least a portion of the covering. Once the portion of the cover 28 has been torn, the user may then remove the remainder of the covering in any suitable manner.

Figure 8:
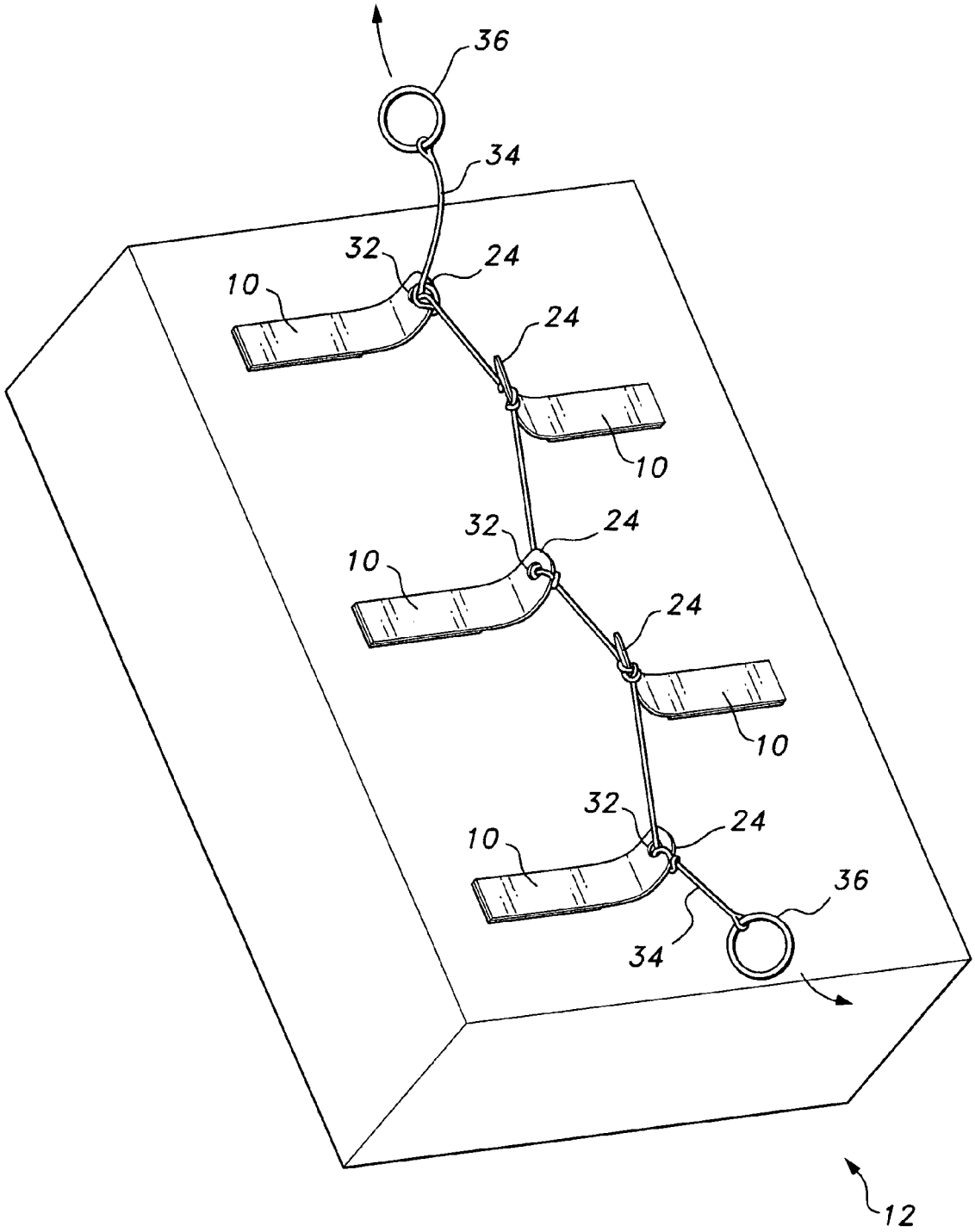
FIG. 8 is an environmental, perspective view of another alternative embodiment of the package opening device according to the present invention.

Alternatively, as illustrated in the embodiment of FIG. 8, a plurality of adhesive strips 10 may be provided, with the plurality of adhesive strips 10 being joined together by a line 34, with user-generated tension in the line 34 creating the tearing force. Each strip 10 is applied to covered package 12 in a manner similar to that described above with regard to the embodiments of FIGS. 1-7. Line 34 is secured to each proximal portion 24, thus joining each proximal portion 24 to the other. Preferably, an opening 32 is formed through each proximal portion 24, allowing the line 34 to be laced therethrough, as shown, and secured to at least the end-most adhesive strip 10. In FIG. 8, the line 34 is shown being tied about each opening 32, thus securing the line to each strip 10. It should be understood that this is shown for exemplary purposes only, and that line 34 may be secured to each strip 10 by any suitable means of attachment. For example, the line 34 may be adhered to each strip 10, sandwiched between material layers formed on each strip 10, or secured in any suitable manner.

Line 34 may be string, fishing line, ribbon, yarn or the like and, in use, the user applies a pulling force to a free end of the line 34, which generates a tearing force in each of the adhesive strips 10, tearing the cover of covered package 12 in multiple places. Preferably, a pair of grasping members 36 are secured to the free ends of line 34. Grasping members 36 may be any suitable grasping member. Each grasping member 36 may be a ring, as shown or other grasping member, similar to that described above with regard to the gripping element 30 of FIG. 7.

It should be understood that the alternating application pattern of the adhesive strips 10, shown in FIG. 8, is for exemplary purposes only, and that the user may apply the strips 10 to the covered package 12 in any desired pattern or location. For example, the multiple adhesive strips 10 may be applied to the covered package 12 in a straight line.

The plurality of adhesive strips 10 may be provided to the user in a portable package, each with its own release liner 22, or secured to a single large release liner 22. The package is preferably portable, allowing the user to selectively apply the package opening device 10 at multiple locations, and to multiple packages 12. Further, a variety of adhesive strips 10, in a wide variety of shapes and sizes, may be provided for selection by the user.

It is to be understood that the present invention is not limited to the embodiments described above, but encompasses any and all embodiments within the scope of the following claims.

I claim:

1. A package opening device, comprising:

a plurality of base strips, each of the plurality of base strips having a proximal portion, a distal portion, an upper surface, and a lower surface;

an adhesive layer at least partially covering the distal portion of the lower surface of each of the plurality of base strips;

an elongated flexible member secured to the proximal portion of each of the base strips, the flexible member joining the plurality of base strips, whereby a user may adhere the distal portions of the plurality of base strips to a cover of a package, the user applying tension to the flexible member to tear at least a portion of the cover of the package; and a first gripping member secured to a first end of the elongated, flexible member.

2. The package opening device as recited in claim 1, further comprising a second gripping member secured to a second end of the elongated, flexible member.

3. The package opening device as recited in claim 1, wherein the elongated, flexible member is selected from the group consisting of a string, a fishing line, a ribbon, and yarn.

4. The package opening device as recited in claim 1, wherein the proximal end of each said base strip has an opening formed therethrough, the flexible member passing through each of the openings of the plurality of said base strips.

5. The package opening device as recited in claim 1, further comprising a release liner releasably covering the adhesive layer of each of said plurality of base strips prior to application to the cover of the package.

6. The package opening device as recited in claim 1, wherein each of the plurality of base strips has a substantially rectangular contour.

7. The package opening device as recited in claim 1, wherein each of the plurality of base strips is formed from a material selected from the group consisting of paper, flexible plastic, and cardboard.

* * * * *